US005572932A

United States Patent [19]

Early

[11] Patent Number: 5,572,932

[45] Date of Patent: Nov. 12, 1996

[54] RAILCAR HATCH COVER

[75] Inventor: Stephen R. Early, Olathe, Kans.

[73] Assignee: Aero Transportation Products, Independence, Mo.

[21] Appl. No.: 325,029

[22] Filed: Oct. 18, 1994

Related U.S. Application Data

[63] Continuation-in-part of Ser. No. 948,116, Sep. 21, 1992, Pat. No. 5,355,808.

[51] Int. Cl.[6] ..... B61D 39/00

[52] U.S. Cl. ..... 105/377.07; 105/377.06

[58] Field of Search ..... 105/377.01, 377.04, 105/377.05, 377.06, 377.07, 377.09, 377.1; 49/371, 103; 220/1.5, 524, 525, 260, 263, 343

[56] References Cited

U.S. PATENT DOCUMENTS

| | | | |
|---|---|---|---|
| 619,029 | 2/1899 | Wallace | 105/377.04 |
| 886,472 | 5/1908 | Brown | 105/377 |
| 1,186,388 | 6/1916 | Fountain | 105/377.04 |
| 1,227,408 | 5/1917 | Ewing | 105/377 |
| 3,664,270 | 5/1972 | Stark et al. | 105/377 |
| 3,831,792 | 8/1974 | Waterman et al. | 105/377.05 |
| 5,355,808 | 10/1994 | Early | 105/377 |

FOREIGN PATENT DOCUMENTS

| | | | |
|---|---|---|---|
| 0265170 | 1/1965 | Australia | 105/377.06 |
| 0621743 | 6/1961 | Canada | 105/377.04 |
| 1104985 | 4/1961 | Germany | 105/377.04 |

*Primary Examiner*—Mark T. Le
*Attorney, Agent, or Firm*—Chase & Yakimo

[57] ABSTRACT

A hatch cover assembly for railcars. The assembly includes a series of hatch covers aligned end to end to cover an opening in a railcar. Each of the hatch covers has an overlapping end section which seats upon an adjacent cover to provide a seal. The end of each hatch cover having this overlap is common such that the covers may be opened sequentially from one end of the railcar to the other without requiring the operator to backtrack. The overlapping section may be formed as a separate element mounted upon the cover. The overlapping element can be mounted for movement between a closed position in which it overlaps the adjacent cover, and an open position in which it is spaced from the adjacent cover. The covers may additionally or alternatively be connected together such that the opening of a cover assists in the opening of an adjacent cover. The covers may be connected by a mechanism, such as a cable or a shaft, such that as the first cover falls completely open from a vertical, partially opened condition, it is fixed to the adjacent cover. This will result in the weight of the first cover assisting in the lifting of the adjacent cover to the vertical, partially opened condition.

4 Claims, 3 Drawing Sheets

RAILCAR HATCH COVER

CROSS-REFERENCE TO RELATED APPLICATIONS

This application is a Continuation-in-Part of U.S. Ser. No. 07/948,116, filed Sep. 21, 1992, now U.S. Pat. No. 5,355,808, which is included herein by reference.

BACKGROUND OF THE INVENTION

1. Field of the Invention

The present invention relates in general to hatch covers for railcars. In particular, the present invention relates to improved hatch cover assemblies providing ease of opening.

2. Description of the Related Art

Railcars have long been employed to transport granular material such as grain. Such railcars typically have a series of openings, or a single opening, in the top of the railcar through which the grain may be loaded, with the openings commonly being referred to as troughs. Associated with these openings are one or more hatch covers which close and seal the openings during transport.

The hatch covers are typically provided in sets of three or more, even where a single elongated opening is employed. The hatch covers are hinged along one or both edges, with the hinges for the hatch covers being substantially coaxial. The edges of adjacent hatch covers are in close proximity. In a first prior art method, a series of battens are supplied to overly and provide a seal between these edges, and at the outermost ends. As such, a railcar having four covers would employ five battens.

While this arrangement has been found serviceable it does have associated problems. For example, it is necessary to release and pivot the battens away from the hatch covers in a separate operation prior to opening the hatch cover. Additionally, the pivot of the batten is subject to wear such that metal portions of the batten tend to contact the hatch cover. The battens are typically formed of steel, while the hatch covers are normally formed of aluminum or fiberglass. As such, the battens tend to damage the hatch cover in time, due to this wear.

According to a second prior art method, best illustrated by U.S. Pat No. 3,664,270 to Stark et al., the ends of the covers overlap to provide the seal. In the Stark patent there are five covers, with the centermost cover overlapping the adjacent covers at each of its ends. Similarly, at their opposite ends these adjacent covers overlap the outermost covers to which they are adjacent. Another example of overlapping covers is shown in U.S. Pat. No. 5,355,808 to the current inventors. In this Early patent, the overlapping pattern may take various forms, but it is preferred that each cover overlap its adjacent cover along a common end. In other words, the right hand end of the covers will always overlap the left hand end of an adjacent cover.

These overlapping covers overcome the disadvantages of the batten bars discussed above. However, due to the overlapping arrangement, it is necessary to open the covers in a particular order. For example, the Stark arrangement would require the operator to open the centermost cover first, then travel to the right to open the adjacent cover, then travel to the right again to open the rightmost cover. After this, the operator must travel to the left to open the other adjacent cover, then travel left again to open the leftmost cover. The Early arrangement reduces the amount of travel needed, as the operator may open the covers sequentially from one end to the next, without any backtracking.

While these arrangements, and in particular the Early arrangement, are improvements over the prior art, there are still further improvements possible. For example, while the overlapping provides good seals with improved longevity, there is still the need to open the covers in a particular order. This may necessitate opening several covers when only one cover was needed open.

Additionally, with all cover arrangements there is the desire to permit limited access to the interior of the railcar, for example to obtain a small sample of grain, with a minimal amount of effort. For most arrangements, it is necessary to open an entire cover. It is possible to provide a hatch within the cover, but this of course drives up the cost of the cover, and increases the risk of cargo contamination through seal failure around the hatch.

Another problem associated with all cover arrangements is the weight of the cover, which must be physically lifted. While contemporary covers are typically formed of aluminum, they are still an appreciable weight to lift. Furthermore, this lifting of the covers is performed on the top of the railcar, increasing the possibility of injury.

SUMMARY OF THE INVENTION

An object of the present invention is to provide an overlapping hatch cover assembly for a railcar which may be fully opened without the need for excess travel by the operator.

Another object of the present invention is to provide an overlapping hatch cover assembly which may be opened sequentially from one end of the railcar to the other.

Another object of the present invention is to provide a railcar hatch cover assembly having the sealing and longevity advantages of an overlapping arrangement with the ease of use of a non-overlapping arrangement.

Another object of the present invention is to provide a railcar hatch cover assembly having overlapping ends which may be selectively moved to a non-overlapping position.

Another object of the present invention is to provide a railcar hatch cover assembly which permits access to the cargo without the need to open a cover.

Another object of the present invention is to provide a railcar hatch cover assembly in which an overlapping cover end may be selectively moved to provide an access opening to the cargo.

Another object of the present invention is to provide a railcar hatch cover assembly in which the opening of the covers is assisted, such that the operator need not lift the full weight of every cover.

Another object of the present invention is to provide a railcar hatch cover assembly in which the weight of a cover is used to assist in opening the adjacent cover.

These and other objects are achieved by a hatch cover assembly for railcars. The assembly includes a series of hatch covers aligned end to end to cover an opening in a railcar. Each of the hatch covers has an overlapping end section which seats upon an adjacent cover to provide a seal. The end of each hatch cover having this overlap is common (i.e., the left end), such that the covers may be opened sequentially from one end of the railcar to the other without requiring the operator to backtrack. The overlapping section may be formed as a separate element mounted upon the cover. The overlapping element can be mounted for movement between a closed position in which it overlaps the adjacent cover, and an open position in which it is spaced from the adjacent cover. As such, the cover may operate as a standard overlapping cover. However, the element may be moved to the open position to allow the covers to be opened out of sequence. The ends of the covers may be spaced from each other such that moving the element to the open position results in a gap between the cover becoming accessible, with the cargo of the railcar being accessible through this gap. The covers may additionally or alternatively be connected together such that the opening of a cover assists in the opening of an adjacent cover. The covers may be connected by a mechanism, such as a cable or a shaft, such that as the first cover falls completely open from a vertical, partially opened condition, it is fixed to the adjacent cover. This will result in the weight of the first cover assisting in the lifting of the adjacent cover to the vertical, partially opened condition. This process may be repeated along the length of the railcar.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
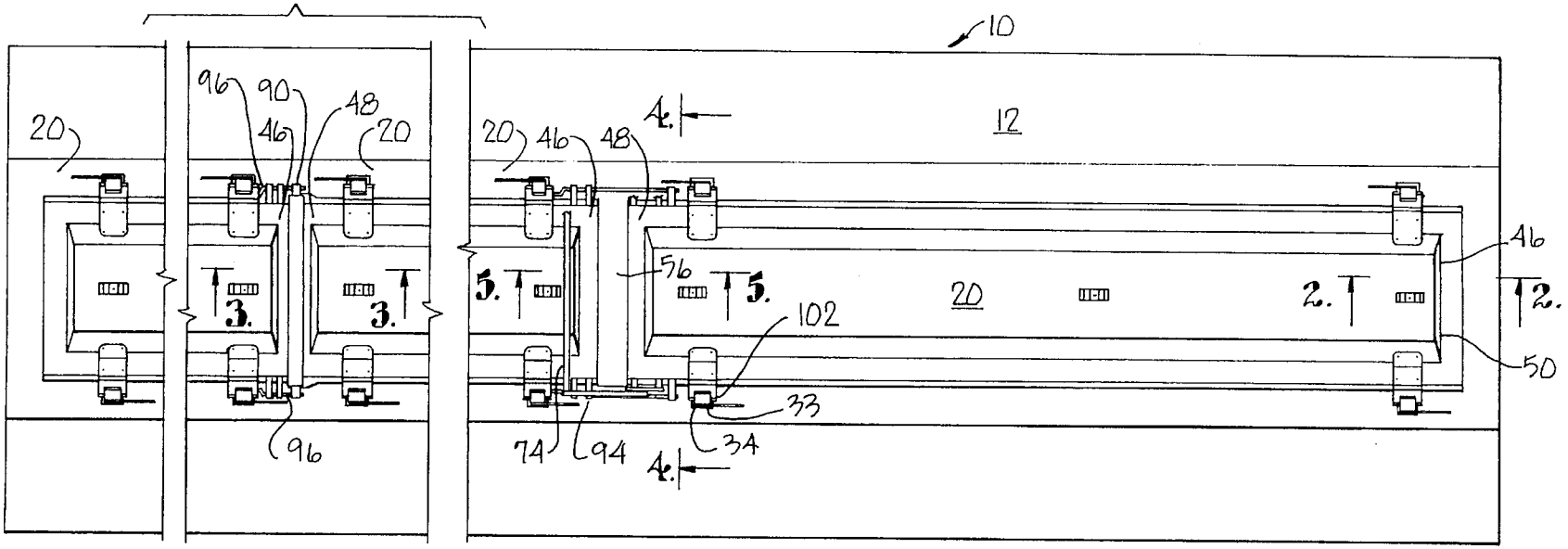
FIG. 1 is a plan view showing a hatch cover assembly according to the present invention.
Figure 4:
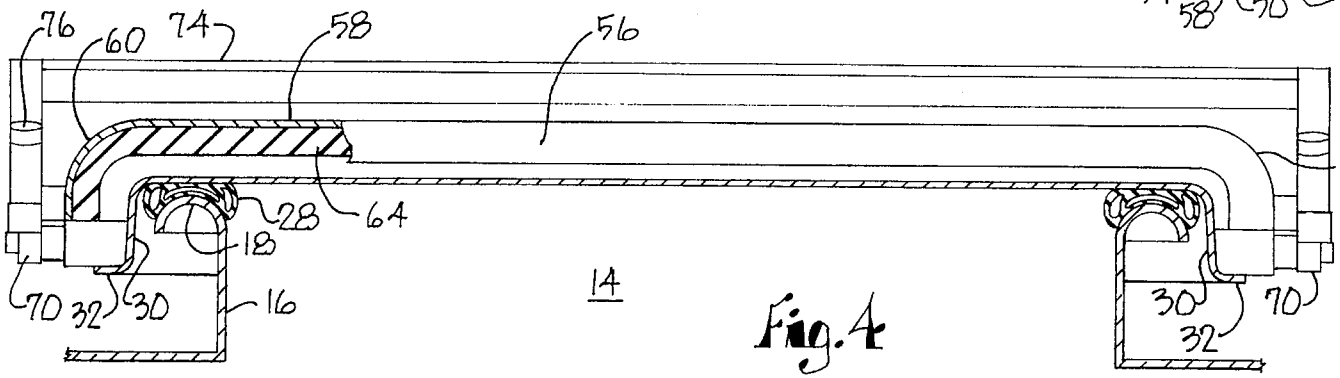
FIG. 4 is a cross-sectional view taken along line 4—4 of FIG. 1.

With reference to FIG. 1, a railcar hatch assembly according to the present invention is generally designated by reference numeral 10. The hatch assembly is mounted upon the upper surface or roof sheet of a railcar 12 which includes at least one trough or opening 14 (FIGS. 2 and 4) extending therethrough. The opening 14 provides access to the interior to the railcar such that granular material, such as grain, may be loaded and unloaded from the railcar.

The opening or openings 14 are substantially rectangular and elongated in the direction of travel of the railcar (hereafter the longitudinal direction). The periphery of the or each opening includes an upward extending trough coaming or sidewall 16 (FIGS. 2 and 4) which provides a sealing surface at its upper end. This sealing surface may advantageously be formed by the upper surface of an arcuate portion 18.

The hatch cover assembly 10 according to a first embodiment of the present invention includes three or more covers 20 which close the opening 14. While various embodiments of covers will be discussed, and are useable together, there are a large number of common features. As such, the similarities between the covers will be first discussed.

Each of the covers may have a generally rectangular configuration elongated in the longitudinal direction. As with the openings 14, in the assembled and closed condition shown in FIG. 1, the covers will be arranged with their longitudinal axes substantially coincident and be arranged in a longitudinally extending line with the longitudinal ends of adjacent covers in proximity. While the covers may be of different lengths, it is preferred that they be substantially uniform for easy replacement.

Figure 2:
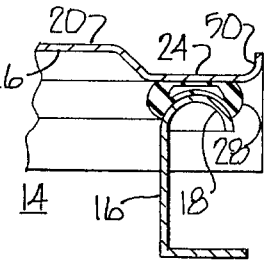
FIG. 2 is a cross-sectional view taken along line 2—2 of FIG. 1.

Each of the covers 20 and 22 will typically have a substantially planar edge portion 24 extending about the periphery of the cover. While the interior portion of each cover could continue with this planar configuration, it is preferred that each cover include a central portion 26 which is raised upward with respect to edge portion 24, and includes transition sections therebetween, to provide the cover with increased stiffness. As is best shown in FIG. 2, the edge portion and central portion preferably have a substantially constant thickness. It is preferred that the covers be formed of aluminum, although fiberglass composites or other materials may be employed.

Figure 3:
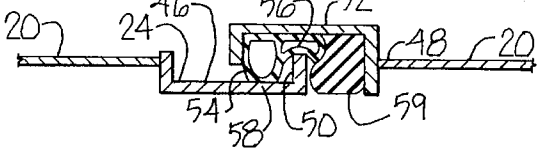
FIG. 3 is a cross-sectional view taken along line 3—3 of FIG. 1.

The covers are sized such that the edge portions 24 are located above the upper end of the sidewalls 16 of the openings, and in particular above the arcuate portion 18, at least at the lateral sides of the covers. In particular, where two or more covers are associated with a single opening, certain ones of the longitudinal ends of the covers will extend laterally across the opening 14. Since by definition there is no sidewall extending laterally across the opening between its longitudinal ends, the edge portions 24 at those certain longitudinal ends will not be located above a sidewall. This situation is illustrated in FIG. 3. At the longitudinal ends of the opening, however, the edge portions 24 are located above the laterally extending sections of the sidewall, as illustrated in FIG. 2.

To eliminate or reduce the ingress of moisture or other contaminants into the railcar, appropriate seals 28 are located on the lower face of the edge portion such that the seals will contact and conform to the arcuate portions 18. As is well known in the art, seals 28 are preferably formed of a rubber or plastic which is resilient to conform to the arcuate portion and thus provide an improved seal. As is shown by comparison of FIGS. 2 and 3, the seals 28 may be located only on those edge portions 24 which are located above a sidewall 16, and as such do not extend laterally in FIG. 3. It is possible, however, to provide lateral seals as shown in FIG. 2 at each longitudinal end of each cover. This would of course result in several of the seals serving no immediate purpose. However, this would make the covers more modular, such that any cover could be put at any location on the railcar. This is not possible with covers which do not include the lateral seals.

To further reduce the possibility of ingress of contaminants, the lateral sides of each cover include a lateral sidewall 30 which extends downward from the outer edge of edge portion 24. For yet further protection and increased strength, a side flange or lateral lip 32 may extend laterally outward from the lower end of each lateral sidewall 30.

The connections of the covers 20 to the railcar may be made along these lateral edges. In particular, a plurality of hinge brackets 33 may be fixed to the upper surface of the railcar 12 adjacent at least a first lateral side of the opening or openings 14, and preferably along both lateral sides of the opening. The hinge brackets define the pivot axis for the associated cover. This pivot axis is substantially parallel to the longitudinal axis of the covers, and would preferably be spaced laterally outward from the furthest lateral extent of the first lateral side of the associated cover, which in this particular configuration would be the outer edge of lateral lip 32.

The covers 20 would then include hinge members 102 fixed thereto at locations substantially corresponding to the hinge brackets (described in more detail below). The hinge member, and thus the associated cover, would be rotatably mounted to the hinge bracket, and thus the railcar. It is preferred to provide the covers with a dual hinge ability. Specifically, it is preferred that the hinge brackets take the form of combination hinge and lock assemblies 34. Such hinge and lock assemblies are of the type which may be placed in a locked condition in which the assembly acts as a hinge, or may be manually unlocked to allow portions of the assemblies to be separated. As such, by employing such assemblies on both lateral sides of a cover, the cover may be securely locked in the closed position, or may be pivoted about either lateral side to the open position simply be releasing the assemblies on the opposite lateral side. A preferred assembly for this arrangement is sold under the mark AZEE by IRECO.

From the above description it should be apparent to those skilled in the art that each of the covers 20 may be pivoted about a pivot axis substantially parallel to the longitudinal direction of the openings 14 to move the cover into and out of covering relation to the opening. When the cover is lying over the opening 14, the latch mechanism or assembly 34 may be engaged to securely retain the cover in the closed position, and to apply a downward pressure to the cover such that the seals 28 will be compressed against the sidewall 16 of the opening.

Each of the covers 20 includes a first and a second longitudinal end, with these ends being oriented similarly for each of the covers. In other words, where the railcar upper surface 12 includes a first and a second longitudinal end, for each of the covers the distance between the first longitudinal end of the railcar and the first longitudinal end of the cover will be less than the distance between the first longitudinal end of the railcar and the second longitudinal end of the cover. As such for adjacent ones of the covers the first and second longitudinal ends of the respective covers will be in proximity. By way of convention, the right hand end of each cover (with respect to FIG. 1) will be designated a first end 46, while the opposite end will be designated second end 48.

While the above description lists the features which are common between the covers 20, the differences between the covers shown in FIG. 1 will now be described. Specifically, as shown in FIG. 1, first end 46 of each cover 20 has a lateral extent substantially corresponding to, or slightly smaller than, that of the lateral sidewalls 30. With reference to FIG. 2, these first longitudinal ends 46 will include an upwardly directed sealing lip 50, as is known in the art. This is true of each cover shown in FIG. 1. However, this is not strictly necessary (as will be apparent below) on the rightmost cover of FIG. 1. This is because the first end of this cover is an extreme end of the cover assembly, and is not in proximity to another cover. As such, this rightmost cover may alternatively not include the reduced lateral extent and/or the sealing lip 50. However, for interchangeability and reduced inventory needs, it is preferred that all covers, even this rightmost cover, include the sealing lip.

Just as the first differences in cover design came at the rightmost end of the rightmost cover, the second differences are shown at the leftmost, or second end 48, of the leftmost cover. As shown in FIG. 1, this extreme end has a reduced lateral extent similar to that on the opposite extreme end. This arrangement may be preferred for mounting the lateral seal necessary at the ends of opening 14, as shown in FIG. 2. However, while it is not shown, it is preferred that this second end of the leftmost cover have a configuration similar to the second end of the other covers, again for interchangeability and reduced inventory.

The second longitudinal end 48 of each of the modular covers itself has two different forms, both of which may be used together, and both of which are shown in FIG. 1. The first form is shown at the intersection of the two leftmost covers, where the second end 48 has a vertical and lateral extent slightly greater than that of the lateral sidewall 30, or at least greater than that of the first end 46, such that it may partially wrap around or over the adjacent first end. This is effected by a compression lip 52 extending longitudinally from the second end 48. The compression lip is spaced vertically above the upper edge of sealing lip 50, as best shown in FIG. 3. Additionally, while the first and second ends 46 and 48 of adjacent covers are provided with a small spacing therebetween, the longitudinal extent of the compression lip 52 is such that it extends a distance beyond the sealing lip 50 of the adjacent cover.

Fixed to the bottom face of the compression lip 52 is a compression seal 54. The compression seal is formed of a resilient material similar to that of seal 28, and extends along the entire lateral length of the compression lip 52. The compression seal 54 includes a first portion 56 positioned to be located directly above the sealing lip 50 of the adjacent cover. The seal 54 also includes a second portion 58, spaced further from the first end of the associated cover than the spacing of the first portion 56 from such first end, and which has a greater vertical extent.

As is best shown is FIG. 3, when the covers are in the closed position the compression seal 54 of each of the modular covers 22 will be placed in sealing compression against the adjacent cover. In particular, the first portion 56 of the seal will compress against the sealing lip 50, while the second portion 58 will compress against the edge portion 24 just inward of such sealing lip 50. With this arrangement it may be seen that the first and second portions of the compression seal provide two separate seals against the ingress of moisture and contaminants.

To provide further seal security, a filler gasket 59 be fixed to the compression lip 52 inward of the first portion 56 and having a length corresponding to that of seal 54. The filler gasket will abut against the longitudinally interior edge of the first portion 56 to improve the seal of this first portion against the sealing lip 50. In particular, the lateral ends of the filler gasket contact the seal 28 extending along the lateral sides of the cover, and a lower longitudinally outer portion of the filler gasket may contact, a portion of the seal 28 of the adjacent cover, thus assisting in the sealing of the lateral ends of the overlapping covers.

In addition to providing an excellent seal, the compression lip 52 and compression seal 54 provide a downward force against the adjacent cover. In particular, the force generated by the hinge elements or assemblies 34 acting upon the right hand cover of FIG. 3 will be transmitted through the compression lid 52 and compression seal 54 to provide a downward force upon the first end of the left hand cover of FIG. 3. This force will be in addition to the force generated by the hinge or assemblies 34 of such left hand cover. This provides additional security in keeping the covers in the closed position.

This arrangement of the compression lip 52 resting upon the sealing lip 50 is common for each of the second and first ends of adjacent covers using this arrangement. It is of course possible to use this sealing lip arrangement on each of the covers. If this is the case, then in operation it is of course necessary to open the covers in a specific order. With particular reference to FIG. 1, the cover closest to the first end of the railcar, which is the only cover which is not compressed by the compression lip of an adjacent cover, must be opened prior to opening of the other covers. Similarly, the next cover closest to this first end of the railcar must be opened next for similar reasons. In general, the covers must be opened sequentially from the first end of the railcar to the second end. While this arrangement does provide limitations on the opening of the covers, it does eliminate the need to unlatch and open the separate battens of the prior art. Additionally, it eliminates the need for the operator to retrace her or his steps, as is required by the overlap pattern in the Stark patent noted above.

Even so, there are advantages to avoiding an overlapping configuration. These advantages are achieved, along with the sealing advantages of an overlapping arrangement, by yet another cover embodiment. This embodiment is shown on the rightmost cover in FIG. 1, and more particularly at the second end 48 of that cover.

Figure 5:
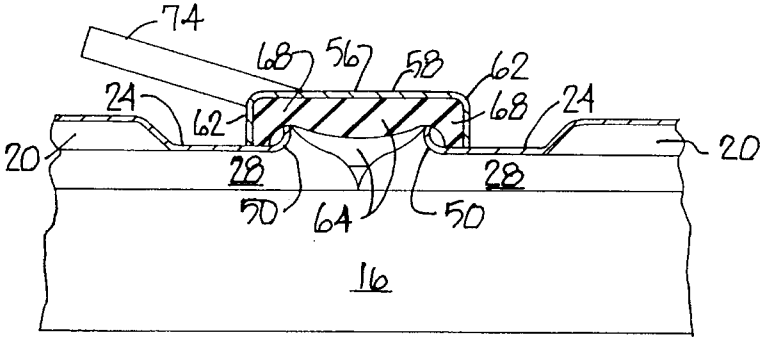
FIG. 5 is a cross-sectional view taken along line 5—5 of FIG. 1.

With reference to FIGS. 1 and 4–7, it may be seen that the second end 48 of the cover of this embodiment is similar to, and preferably identical to, the first end 46. in particular, the second end 48 includes the upstanding sealing lip 50 extending laterally across the second end. As such, when the covers are in the closed position, there will be two sealing lips 50 from the adjacent covers in opposed relation, as best shown in FIG. 5.

Additionally, there is mounted to the second end 48 a sealing element 56. This sealing element includes a sealing shell 58 which extends laterally across the cover and has downward curved lateral ends 60, with the curvature of the ends corresponding to that of the lateral sidewall 30 of the cover. The shell 58 also includes longitudinal edges 62, which are preferably also curved downward, such that the shell 58 defines a downward concave interior. As is best shown in FIG. 5, the longitudinal edges 62 are spaced such that the shell has a longitudinal length greater than the distance between the opposed sealing lips 50.

Mounted to the shell 58 within the concave interior is a double seal 64. The double seal is similar to the compression seal, and is formed of a resilient material similar to that of seal 28, and extends along the entire lateral length of the shell 58. The double seal 64 includes a longitudinally central portion 66 positioned to be located directly above the sealing lips 50 of the adjacent covers. The seal 64 also includes longitudinal end portions 68, which have a greater vertical extent.

As is best shown is FIG. 5, when the covers are in the closed position the double seal 64 mounted to the right-hand cover will be placed in sealing compression against the sealing lips of both the right- and left-hand covers. In particular, the central portion 66 of the seal will compress against the sealing lips 50, while the end portions 68 will compress against the edge portions 24 just inward of each sealing lip 50. With this arrangement it may be seen that the first and second portions of the seal provide two separate seals against the ingress of moisture and contaminants.

An important feature of this embodiment is that the sealing element 56 is mounted to the cover by means 69 permitting movement between an open and a closed position. A preferred embodiment of such a means is shown in FIGS. 6 and 7.

As shown, the means includes parallelogram linkages, with one linkage mounted at each of the lateral ends 60. Each of the linkages includes first and second links 70 and 72. The bottom end of each of the links is pivotally mounted to the cover 20, and in particular to the sidewall 30. the upper ends of the links are pivotally mounted to the associated end 60 of the shell, such that the links will maintain a parallel relationship during movement.

Figure 6:
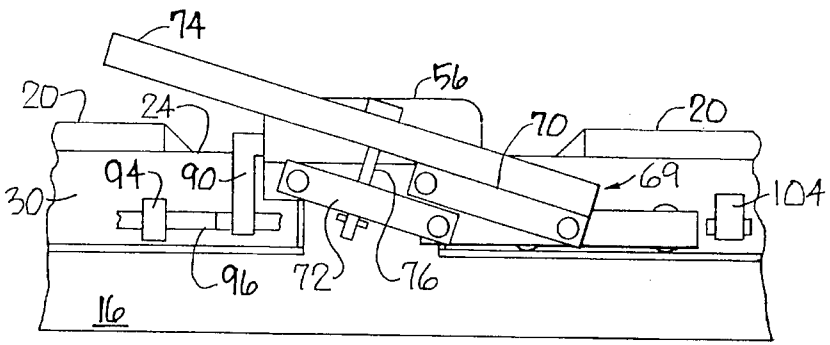
FIG. 6 is a detail side view showing an overlapping mechanism in a closed position.
Figure 7:
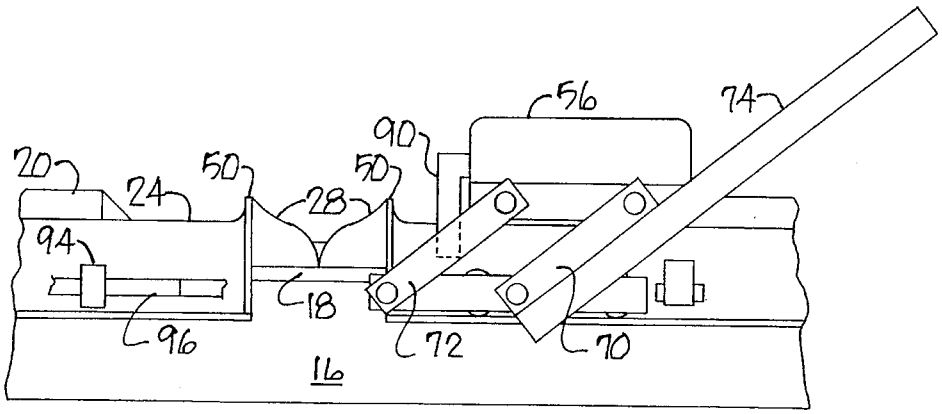
FIG. 7 is a detail side view showing an overlapping mechanism in an open position.

As may be seen from comparison of FIGS. 6 and 7, the means 69 will permit the sealing element to be placed in a closed position (FIG. 6), where the double seal will engage the adjacent covers as shown in FIG. 5. The means also permits the sealing element to be moved to an open configuration where the double seal is spaced from the sealing lip of the adjacent cover sufficiently that the adjacent cover may be opened without interference from the sealing element. In the embodiment shown, the linkages will move the sealing element upward and away from the adjacent cover. The upward movement is sufficient for the end portion to clear the sealing lip, and the longitudinal movement is sufficient that the longitudinal edge of the sealing element is spaced from the sealing lip 50 of the adjacent cover.

To ease the manual movement of the sealing element, there is provided a manual handle 74 fixed to the interior first links 70. The handle 74 extend outward from the upper end of the links, and laterally across the cover. As such, the handle may be easily grasped from either side of the cover. As may be envisioned, pivoting of the handle will cause pivoting of the links, and thus movement of the sealing element.

Various other arrangements may be employed to the means for moving the sealing element. For example, there may be provided side frames having slots, with the sealing element having laterally extending pegs which ride within the slots. Other link arrangements are also possible other than a parallelogram linkage. Alternatively, the sealing member may simply pivot between the open and closed positions.

It is desirable to provide a latch for locking the sealing element in the closed position. This will ensure that the double seal engages with the covers to maintain integrity. The latch may take many forms, such as a pin 76 extending through holes (not shown) in each of the links 70 and 72, which holes are aligned when the links are in the closed position. Various other latches may be employed with this or other means for moving.

With this arrangement for the cover, the sealing element may be locked in the closed position to seal the railcar. In this closed position, the sealing element acts as a sealing lip. The covers may be opened in the manner described above for that embodiment, and thus must be opened in a particular order. However, the sealing element may be moved to the open position, and thus permit the adjacent cover to be opened without first opening the cover which carries the sealing element. As such, the benefits of an overhanging sealing lip are maintained, but the disadvantages of the opening operation are eliminated.

A further advantage may be provided by this arrangement also. As shown in FIG. 5, the sealing lips 50 of the adjacent covers may be formed such that there is an appreciable space therebetween, such as on the order of 8 cm (3 inches). When the sealing element is closed, this space is sealed. However, when the sealing element is moved to the open position, the space is accessible. This space can thus act as an access port to the interior of the railcar, such as for inserting a tool to obtain a sample of grain carried in the railcar.

If the sealing lips are spaced, it is necessary to extend the seal 28 longitudinally outward of the sealing lip 50 to provide the seal 28 in the space between the lips. As shown in FIG. 5, the seal 28 from each cover may extend for half the space, and meet each other in the middle. The angled ends of the seals shown in that figure may be sufficient for some applications. However, it may be necessary to form the seals with more blunt ends which abut to provide proper sealing. Complimentary angles which result in overlapping seal ends would of course be preferred, however, this may reduce the ability to open the covers out of order if the angle is too severe. The lateral ends of the double seal may be extended to a point adjacent the seal 28 such that the double seal assists in the sealing along the coaming at the intersection of the two covers. Furthermore, there could be provided an enlarged portion on the double seal which fits between the ends of the seals 28 when the sealing element is in the closed position.

As may be envisioned, the movable sealing element provides for operation similar to an overlapping cover, and a nonoverlapping cover. This arrangement therefore provides for the advantages of both cover types. As noted above, while all of the covers may be of this type, the movable sealing element covers may be intermixed with the standard overlapping covers as desired.

With reference to FIGS. 8–13, there are shown two embodiments of a further feature according to the present invention. In particular, there are shown covers 20 which are provided with means 78 for assisting in moving an adjacent cover into a partially opened condition.

Figure 8:
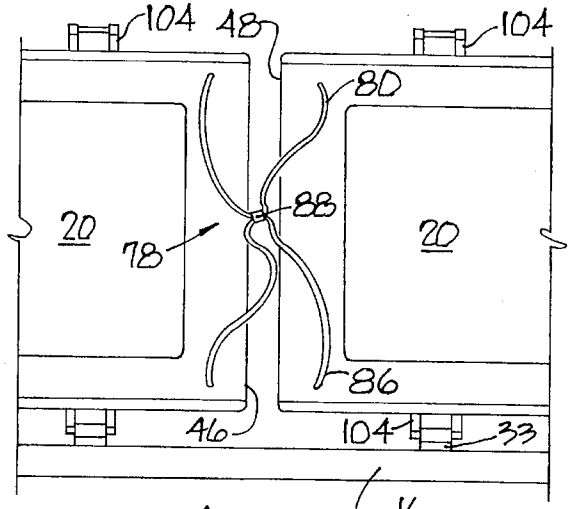
FIG. 8 is a partial plan view of two partially opened covers showing a first embodiment of a cover opening mechanism.
Figure 10:
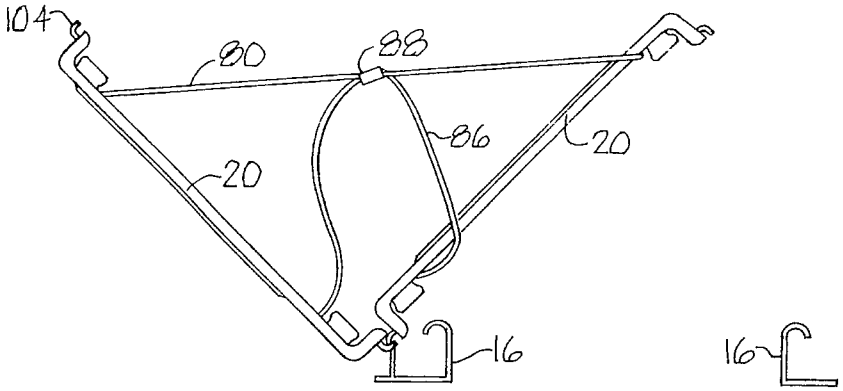
FIGS. 9 and 10 are schematic depictions of the operation of the mechanism of FIG. 8.
Figure 9:
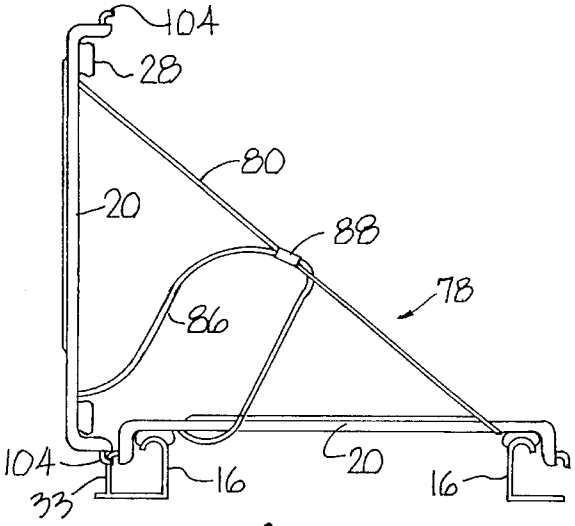

With reference to FIGS. 8–10, a first embodiment of the means 78 is shown. As shown in FIG. 8, the means 78 includes a first cable 80, which has a first end secured to a cover 20 in proximity to the end 46 thereof, and in proximity to a first lateral edge. A second end of the cable is secured to an adjacent cover 20 in proximity to the end 48 thereof, and also in proximity to the first lateral edge. It is preferred that the cable extend along the underside of the covers, and as such the ends of the cable may be secured to the underside of the covers with appropriate bolts, etc.

Where the covers are of the double-hinged variety, a second cable 86 is provided, and is attached to the covers in a similar manner, with the only difference being that its ends are in proximity to a second lateral edge of the covers. To reduce the possibility of fouling the cables, they may be secured together at their centers by a standard clamp 88.

The operation of the means 78 will now be described with reference to FIGS. 9 and 10. As shown in FIG. 10, a first one of the covers may be lifted into a partially opened configuration, with the cover extending in a generally vertical plane. The motion of the first one of the covers into this position has not engage the means 78, but the means is engaged at this position. For this particular embodiment, the cable is provided with a sufficient length that it becomes taught only when the first one of the covers reaches this position.

From this point, the movement of the first one of the covers to the fully opened position is continued. However, due to the presence of the cable, continued movement of the first one of the cables results in movement of the adjacent cover. This has the effect that the weight of the first cover is used to pull the adjacent cover upward in the opening direction. For covers having similar dimensions and mass, the potential energy of the partially opened first cover should be sufficient to raise the adjacent cover into a position having similar potential energy.

As such, the operator exerts a typical force to open the first cover to the position shown in FIG. 9. At this point the center of mass of the first cover is nearly directly above the pivot axis for the cover, while the center of mass of the adjacent cover is at a much greater distance. For this reason it is still necessary for the user to exert a manual force to move the first cover downward, which would not be necessary without the means 78. However, the lever arms for the two centers of mass reverse with greater movement toward the fully open position of the first cover, such that application of force should not be necessary through the full movement.

For this first cover, then, the force needed to open the cover is increased. However, at this point the first cover has lifted the second cover to the partially opened position. Therefore, the operator need only apply that incremental force to move the adjacent cover to the fully opened position.

As may be envisioned, opening the covers about the opposite hinge axis will result in the other cable 86 becoming taught at the partially opened position, such that this same operation may work from both sides. Additionally, means 78 may be associated with all the covers, such that fully opening the adjacent cover results in lifting of the next adjacent cover, and so on down the line. Furthermore, this same effect is achieved upon the closing of the covers.

Figure 13:
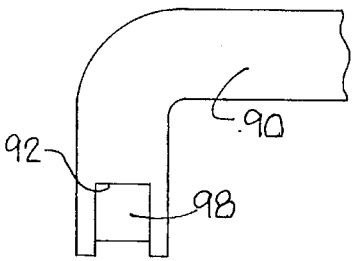
FIGS. 12 and 13 are views taken along lines 12—12 and 13—13 of FIG. 11.
Figure 12:
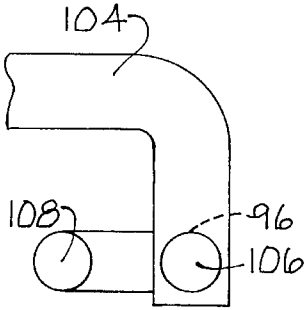
Figure 11:
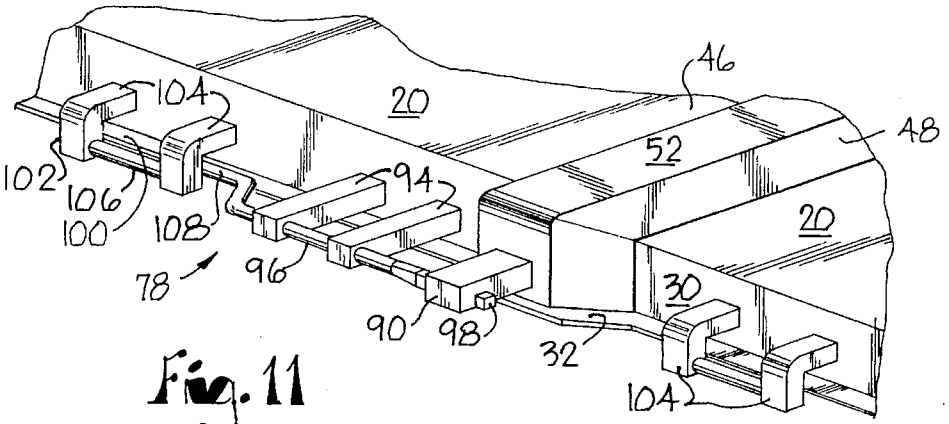
FIG. 11 is a perspective view of a second embodiment of a cover opening mechanism.

A second embodiment for the means 78 is shown in FIGS. 11–13. In this embodiment the first cover 20 includes a clamp bar 90 extending laterally from the cover lateral sidewall 30 adjacent the end 48, and preferably on the compression lip. As best shown in FIG. 13, the clamp bar includes a longitudinally extending, downward opening clamp slot 92. The slot 92 will have a prismatic shape, and the slot may flare outwardly at the bottom, for reasons made clear below.

Mounted to the adjacent cover near the end 46 are one or more journal blocks 94. The journal blocks mount a longitudinally extending torsion rod 96. The rod 96 has a first end 98 which extends longitudinally beyond the end 46 of the cover, with the free end having a prismatic shape corresponding to that of the slot 92. Additionally, the length of the first end is sufficient such that when the covers are in the closed position the first end 98 is received within the slot 92. As may be envisioned, the mating prismatic shape prevents relative rotation of the rod 96 within the slot.

The rod 96 has a second end 100 which extends to a position adjacent the hinge member 102 on the cover. The hinge member will include one or more support bars 104 extending from the cover to a hinge axis 106. The hinge axis may be formed by a through hole which receives a hinge pin, or by a hinge pin itself, with this latter arrangement being shown in the drawings.

As best shown in FIG. 12, it is preferred that the rotational axis of the journal blocks 94, and the longitudinal axis of the rod 96 be coaxial with the hinge axis 106. However, the second end of the rod 96 includes two curves such that there is formed an offset section 108. This offset section extends adjacent to the hinge axis and more particularly to a position adjacent the support bars 104. As the rod 96 is fixed against rotation with respect to the clamp bar 90, the offset section takes an angular position with respect to the support bars 104. This angular position is set such that approximately 90° of rotation of the torsion rod 96 will bring the offset section into abutment with the support bars 104.

From this description it may be seen that opening the first cover about the hinge axis adjacent this means 78 will result in the rotation of the clamp bar 90 about the hinge axis. This in turn will result in rotation of the torsion rod 96. Due to the position of the offset section 108 of the rod 96, initial opening of the first cover will simply result in free rotation of the rod 96. However, when the first cover has rotated approximately 90° to the partially opened position, the offset section will abut against the support bars 104 of the hinge member for the adjacent cover.

Further rotation of the first cover will therefore result in the offset section applying a force against the support bars 104. This force is offset from the hinge axis, and will therefore force rotation of the support bars about the hinge axis. Since the support bars are fixed to the adjacent cover, the adjacent cover will therefore be rotated to the partially opened position as the first cover completes its movement to the fully opened position, in a manner similar to the first embodiment.

Also as with the first embodiment, it may be seen that this means may be employed between several or all the covers, such that the mechanisms operate down the line as the covers are opened, and that the means will operate to close the covers also. Additionally, this means may be used on both lateral sides of the covers, as shown in FIG. 1. In this regard it is noted that the downward opening clamp slot 92 allows the clamp bar 90 to move freely upward from, and downward onto, the first end 98 of the rod 96, in order to permit the bar and rod to separate and disengage so such that the means which is not being employed does not interfere with the means which is employed.

This means may also be utilized with the sealing element described previously. With reference to FIGS. 6 and 7, it may be seen that the clamp bar 90 may be mounted to the shell of the sealing element, such that the clamp bar engages the rod 96 when the sealing element is in the closed position, but disengages from the rod 96 when the sealing element is in the open position.

In the above description of the means 78 reference has been made to the cover opening approximately 90°. This can be between approximately 75°–105°, with it typically being preferred that the cover open slightly more than 90°. This will help to maintain the cover in the upright position against its own weight.

It is to be noted that various modification may be made to this second embodiment. For example: the rod 96 could eliminate the offset section and be secured to the hinge axis with a coupling which allows the restricted rotation; the journal blocks could be mounted to the top of the railcar rather than to the cover; the connection between the clamp block and the rod could be reversed, etc.

Similarly, the means 78 could take other various forms, such as a rod extending between the hinge axes of the covers, with the desired restricted rotation at a coupling in the rod. Other arrangements should be apparent to those within the art.

From the foregoing it will be seen that this invention is one well adapted to attain all ends and objects hereinabove set forth together with the other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

I claim:

1. A hatch assembly for railcars having at least one opening therein extending in a longitudinal direction, comprising:

a plurality of covers, each having lateral sides and a first and a second longitudinal end, said covers being arranged in a longitudinal series along the longitudinal direction and oriented in a common manner such that said longitudinal ends have the same orientation for each of said covers, adjacent covers having associated longitudinal ends in proximity to each other in closed position to therefore define at least one set of adjacent longitudinal ends;

hinge means selectively permitting pivoting of each of said covers from its closed position in overlying relation to said opening to a partially open position in a generally vertical plane, and further to a fully open position providing access to said opening, said pivoting being about an axis substantially parallel to said longitudinal direction; and opening assist means for permitting free movement of a first of said covers from said closed to said partially open position, and for causing opening movement of an adjacent one of said covers to said partially open position in response to continued movement of said first cover to said fully open position, said assist means including a rotary coupling member movable with said first cover and extending generally longitudinally therefrom, said member having operating means engageable with said adjacent one cover when said first cover reaches said partially open position for effecting said opening movement of said adjacent one cover as the first cover continues movement to its fully open position.

2. The hatch assembly as claimed in claim 1, further comprising means securing said rotary member to said first cover adjacent said axis, said operating means cooperating with the hinge means of said adjacent one cover to cause said opening movement thereof.

3. The hatch assembly as claimed in claim 2, wherein said operating means is offset from said axis.

4. The hatch assembly as claimed in claim 1, further comprising a second hinge means for said covers selectively permitting opening and closing movement thereof about a second longitudinal axis substantially parallel to said first-mentioned axis, and means releasably securing said rotary member to said first cover adjacent said first-mentioned axis to permit separation of said first cover from said member when the first cover is swung open about said second axis.

* * * * *